US006378733B1

(12) United States Patent
Boonzaier

(10) Patent No.: US 6,378,733 B1
(45) Date of Patent: Apr. 30, 2002

(54) BOX

(75) Inventor: Graham Harry Boonzaier, Stellenbosch (ZA)

(73) Assignee: Fleurfontein Mountain Estates (Proprietary) Limited, Stellenbosch (ZA)

( * ) Notice: Subject to any disclaimer, the term of this patent is extended or adjusted under 35 U.S.C. 154(b) by 0 days.

(21) Appl. No.: 09/582,280

(22) PCT Filed: Dec. 23, 1998

(86) PCT No.: PCT/GB98/03898

§ 371 Date: Aug. 8, 2000

§ 102(e) Date: Aug. 8, 2000

(87) PCT Pub. No.: WO99/33706

PCT Pub. Date: Jul. 8, 1999

(51) Int. Cl.[7] ..... B65D 35/56

(52) U.S. Cl. ..... 222/105; 222/81; 229/117.13; 229/117.14; 229/156; 220/630

(58) Field of Search ..... 222/81, 83, 105; 229/156, 117.13, 117.14; 220/630

(56) References Cited

U.S. PATENT DOCUMENTS

| | | | | | |
|---|---|---|---|---|---|
| 1,965,503 | A | * | 7/1934 | Lowman | 229/52 |
| 2,090,882 | A | * | 8/1937 | Zimmerman | 229/52 |
| 3,258,192 | A | | 6/1966 | Kelty | 229/39 |
| 3,363,807 | A | * | 1/1968 | Powell | 222/105 |
| 4,238,068 | A | * | 12/1980 | Ellerbe et al. | 229/39 R |
| 4,322,018 | A | * | 3/1982 | Rutter | 222/83 |
| 4,347,970 | A | * | 9/1982 | Nardone | 229/39 R |
| 4,447,004 | A | * | 5/1984 | House et al. | 229/52 B |
| 4,815,631 | A | * | 3/1989 | Eeg et al. | 220/403 |
| 5,318,220 | A | * | 6/1994 | Gagliardo | 229/157 |
| 5,400,955 | A | * | 3/1995 | Coalier et al. | 229/108 |
| 5,497,899 | A | | 3/1996 | Wuerfel | 220/465 |
| 5,562,227 | A | * | 10/1996 | Takezawa et al. | 220/403 |
| 5,584,430 | A | * | 12/1996 | Mulry | 229/117.16 |
| 5,826,752 | A | * | 10/1998 | Latimer | 222/105 |

FOREIGN PATENT DOCUMENTS

| | | | |
|---|---|---|---|
| DE | 7625710 | 12/1976 | |
| EP | 0483444 | 5/1992 | |
| GB | 1100400 | 1/1968 | |
| GB | 2135277 | 8/1984 | |
| GB | 2206564 A * | 1/1989 | B65D/5/46 |

* cited by examiner

*Primary Examiner*—Henry C. Yuen
*Assistant Examiner*—Frederick Nicolas
(74) *Attorney, Agent, or Firm*—Roylance, Abrams, Berdo & Goodman, L.L.P.

(57) ABSTRACT

A box is erected from a blank and has a rectangular bottom, four sides and a rectangular top. The top is formed by four flaps, each extending foldably from an upper edge of one of the sides. These flaps overlap and interlock with one another. The flaps are additionally provided with finger-grip openings dimensioned to receive fingers of a person carrying the box. The arrangement of the openings is such that when the box is carried by fingers received in the openings provided in the opposing flaps, the interlock between the flaps prevents the flaps from parting from one another.

19 Claims, 8 Drawing Sheets

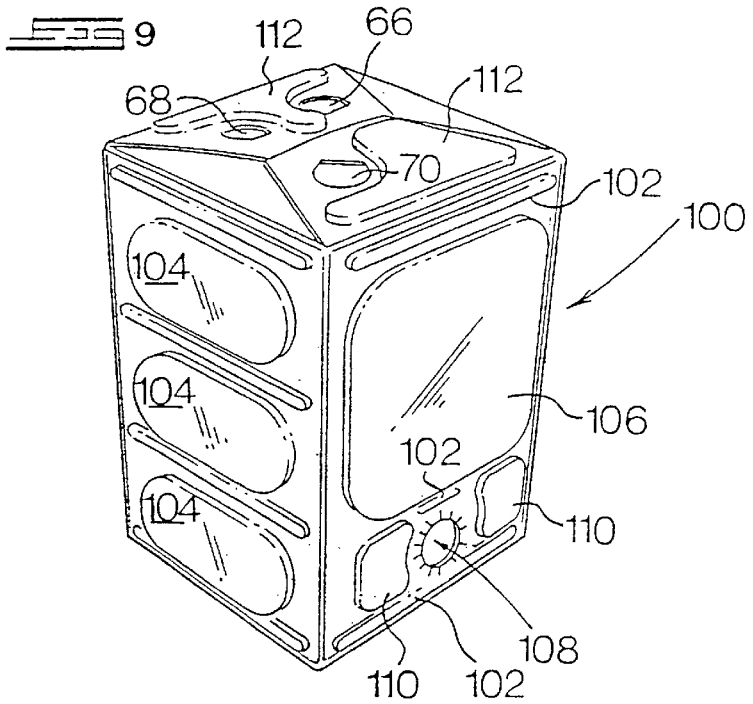
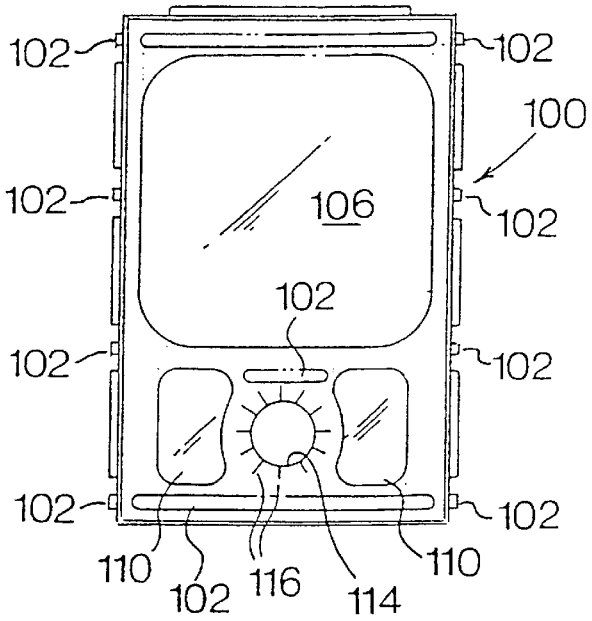
10
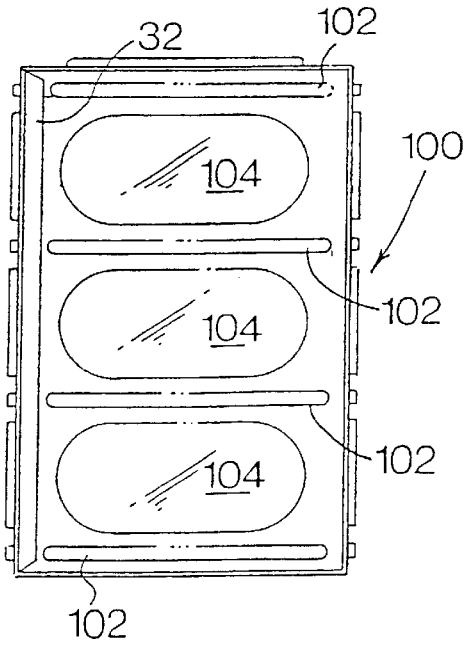
11

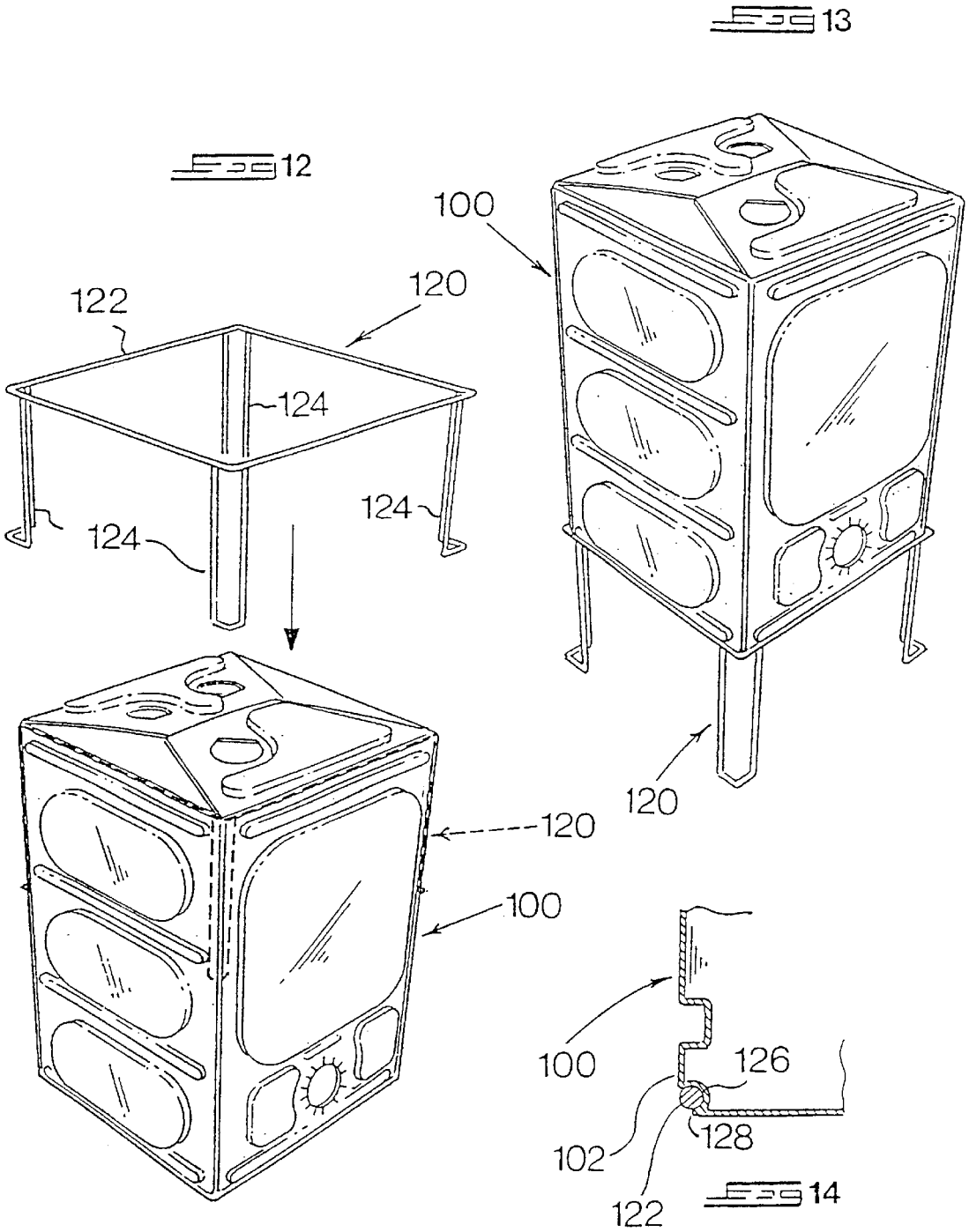
13
12
100
120
122
124
124
124
120
120
100
100
126
102
128
122
14

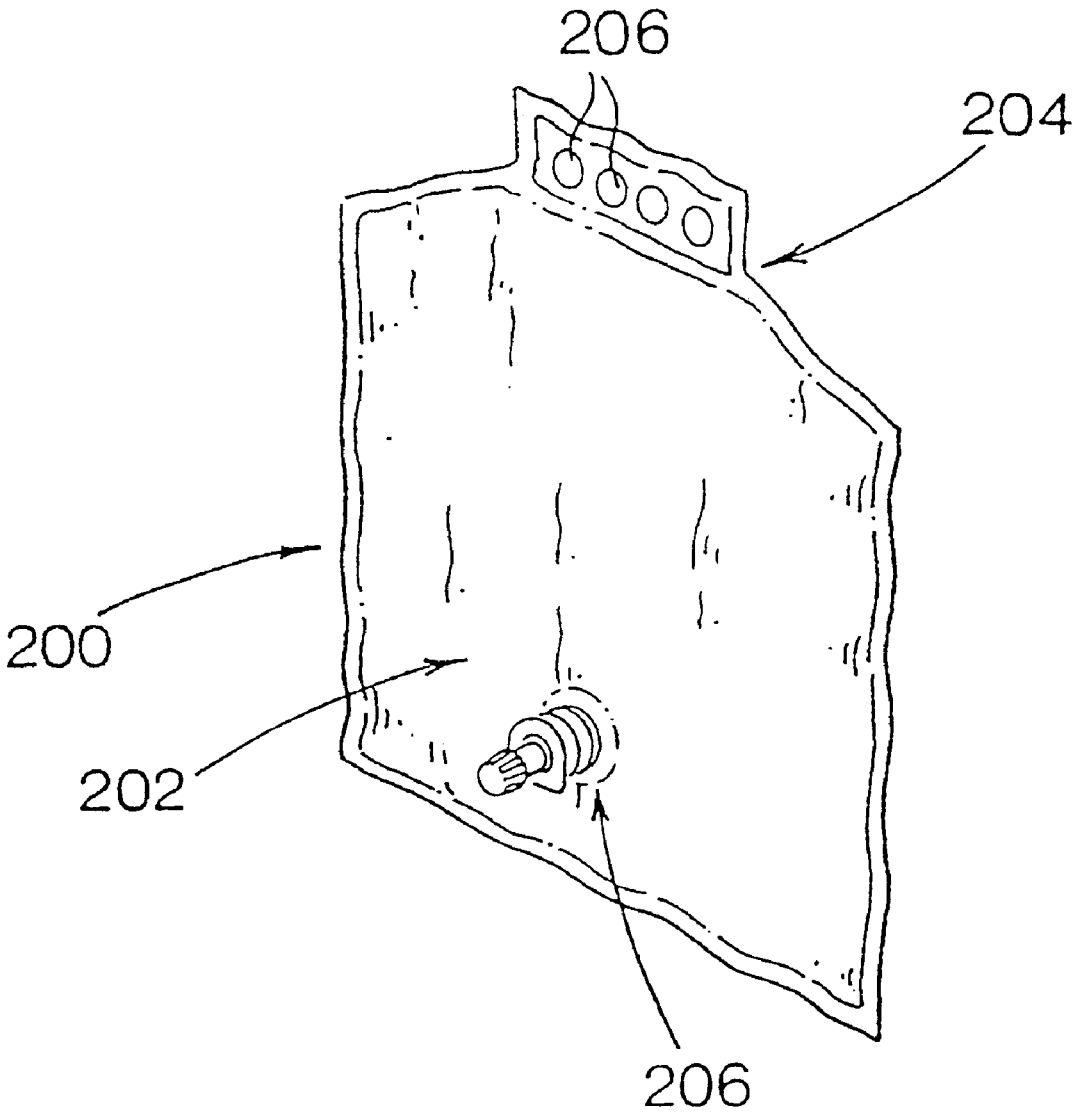
15

BOX

BACKGROUND TO THE INVENTION

THIS invention relates to a box for use in a bag-in-the-box application.

In a bag-in-the-box application, there is a flexible bag located within a rigid box. The bag has a dispensing valve which, in use, projects outwardly through an opening in a wall of the box. Thus by simply manipulating the valve it is possible to dispense the contents of the internal bag under gravity.

One disadvantage of the known boxes used in bag-in-the-box applications is the fact that they have a separate handle for carrying purposes. This is usually a thin strap of tough plastics material with transverse engaging formations at either end which must be inserted through small slots formed in the top of the box. Apart from the difficulties often experienced in correctly fitting the handle in the beginning, the handle often gets lost. The handle also considerably increases the cost of the box.

SUMMARY OF THE INVENTION

According to the present invention there is provided a box, for-bag-in-the-box applications, which is erected from a blank and which has a rectangular bottom, four sides and a rectangular top, the top being formed by four flaps each extending foldably from an upper edge of one of the sides, the flaps of the top overlapping and interlocking with one another and furthermore being formed to provide finger-grip openings dimensioned to receive fingers of a person carrying the box, such openings being provided at least in two opposing flaps of the top and the arrangement of the openings being such that when the box is carried by fingers received in the openings provided in the opposing flaps, the interlock between the flaps prevents the flaps from parting from one another.

The preferred box comprises first and second identical and opposing flaps, a third flap which is engaged by the first and second flaps with the first and second flaps locating partially over and partially beneath the third flap, and a fourth flap having a tongue portion which locates over the first and second flaps and beneath the third flap at a position where the first and second flaps locate beneath the third flap, the first, second and third flaps each being formed to provide a finger grip opening and the fourth flap being formed to provide two spaced finger grip openings, the finger grip openings of the fourth flap aligning with the finger grip openings of the first and second flaps in the assembled top. The finger grip openings may be provided by holes in the flaps, but are preferably provided by press-out tabs in the flaps.

Other features of the box are defined in the appended claims.

Further according to the invention there is provided a liquid storage and dispensing apparatus comprising a box as summarised above and a stand for supporting the box above a supporting surface, the stand comprising an upper portion for supporting the box and a plurality of legs for supporting the upper portion and box above the supporting surface. Conveniently, the upper portion of the stand comprises a rectangular ring and the box includes raised, transverse ribs on its sides adjacent the bottom of the box, the ring being dimensioned to receive the bottom of the box with the ribs resting thereon. The box may in addition includes raised, transverse ribs on its sides adjacent the top of the box and the stand is locatable with the ring resting on these ribs and its legs extending down the corners of the box.

The apparatus may furthermore include a liquid storage and dispensing bag dimensioned to be located, when charged with liquid, in the box.

Still further according to the invention there is provided a liquid storage and dispensing apparatus comprising a box as summarised above and a bag locatable in the box, the bag including a liquid storage volume, an outlet from the liquid storage volume, a manually operable bag for controlling flow of liquid through the outlet and an operatively upper region formed with finger grip openings by means of which the bag can be gripped and carried by the fingers of a human hand.

BRIEF DESCRIPTION OF THE DRAWINGS

The invention will now be described in more detail, by way of example only, with reference to the accompanying drawings in which:

FIG. 9 shows a perspective view of a box according to a second embodiment of the invention;

FIG. 10 shows a side view of the box of FIG. 9;

FIG. 11 shows a rear view of the box of FIG. 9;

FIG. 12 shows a stand which can be used in combination with the box of FIG. 9;

FIG. 13 illustrates the stand in use;

FIG. 14 shows, in a cross-sectional detail, how the stand supports the box; and FIG. 15 shows a bag which can be accommodated in the boxes seen in the above Figures.

DESCRIPTION OF THE ILLUSTRATED EMBODIMENTS

Figure 1:
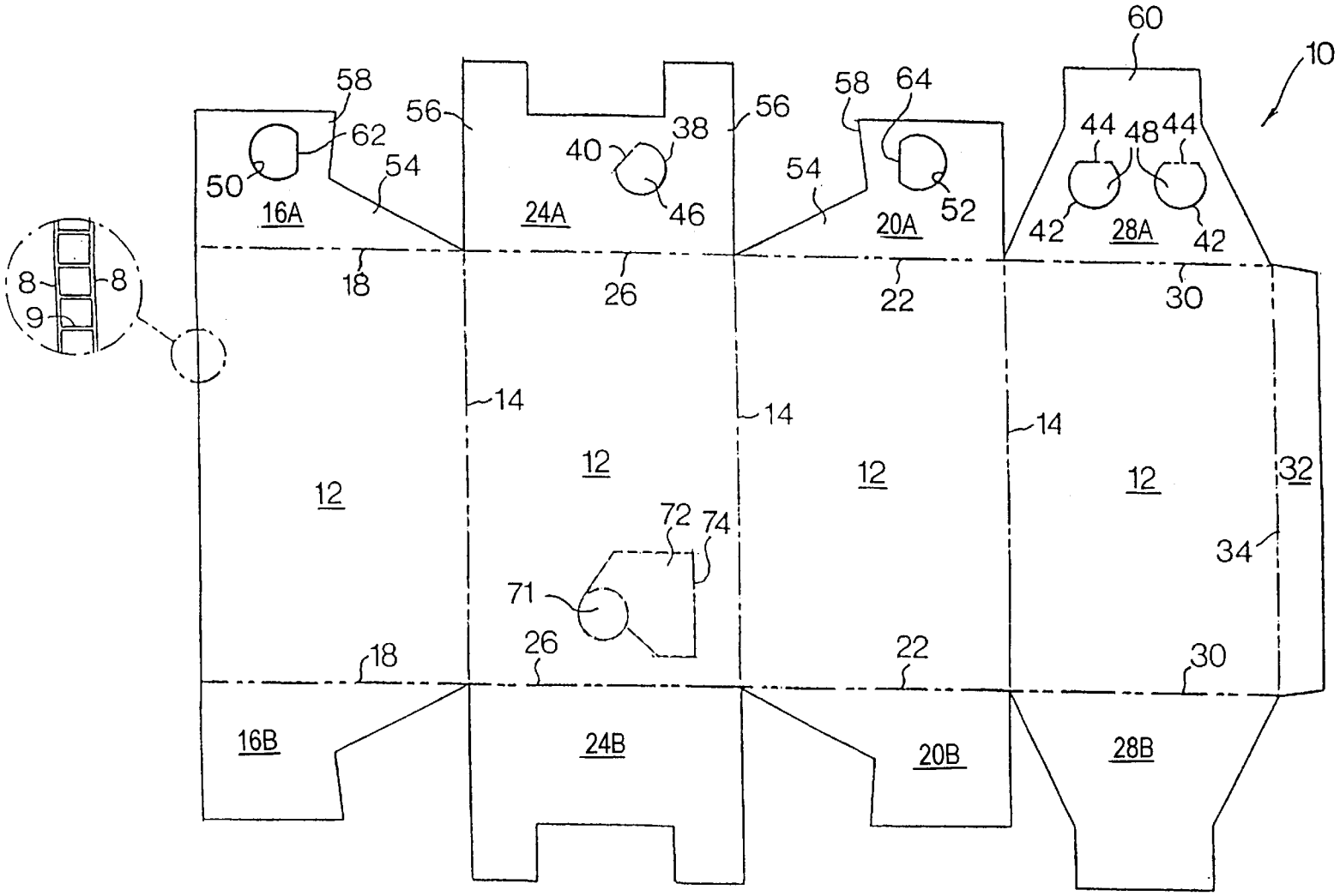
FIG. 1 illustrates a blank from which a box according to a first embodiment of the invention can be erected.

The blank 10 seen in FIG. 1 can be cut from conventional, corrugated cardboard. Alternatively it may be cut from extruded plastics sheet of a known type, such as that marketed under the trade mark CORAPLAS, which has parallel skins 8 spaced apart from and connected to one another by thin webs 9 extending transversely to the skins 8.

As shown, the blank 10 has four panels 12 with fold or crease lines 14 between them at which they can be folded relative to one another. First flaps 16A and 16B are connected to opposite ends of one of the panels 12 at fold lines 18. Second flaps 20A and 20B, identical to but mirror images of the flaps 16A and 16B respectively, are connected to opposite ends of a second of the panels 12 at fold lines 22. Third flaps 24A and 24B are connected to opposite ends of a third of the panels 12 at fold lines 26. Fourth flaps 28A and 28B are connected to opposite ends of the fourth panel 12 at fold lines 30. Finally, a narrow tab 32 is connected to the last-mentioned panel 12 at a fold line 34.

As will be apparent from the following description, the panels 12 form the sides of the assembled box 36 (FIG. 6), the flaps 16A, 20A, 24A and 28A form the top of the box and the flaps 16B, 20B, 24B and 28B form the bottom of the box.

Each of the flaps 16A, 20A, 24A and 28A is formed to provide a finger grip opening. In the case of the flap 24A a C-shaped cut 38 is made through the material of the blank during the printing of the blank 10. In addition, a fold line 40 is formed. In the case of the flap 28A two similar C-shaped cuts 42 and corresponding fold lines 44 are made during printing. As will be explained subsequently, this allows tabs 46, 48, hinged at the fold lines 40, 44 to be pressed out of the general plane of the tabs to provide the required finger grip openings. In the case of the flaps 16A and 20A holes 50, 52 provide the finger grip openings.

As a first step in the erection of the box 36, the panels 12 are folded relative to one another to form a rectangular section tube and the tab 32 is glued to the inner surface of the panel 12 carrying the tabs 16A and 16B. This gives the configuration seen in FIG. 2 with the panels 12 forming the sides of the box.

Figure 3:
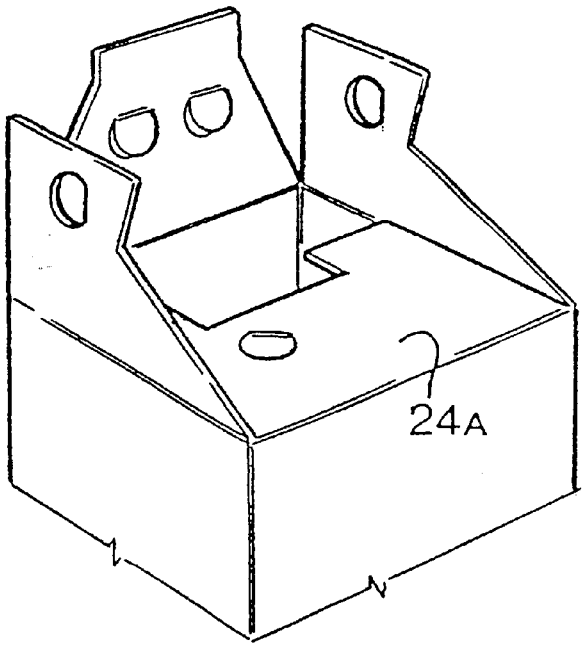
FIGS. 3 to 5 show different stages in the formation of the top of the box.
Figure 4:
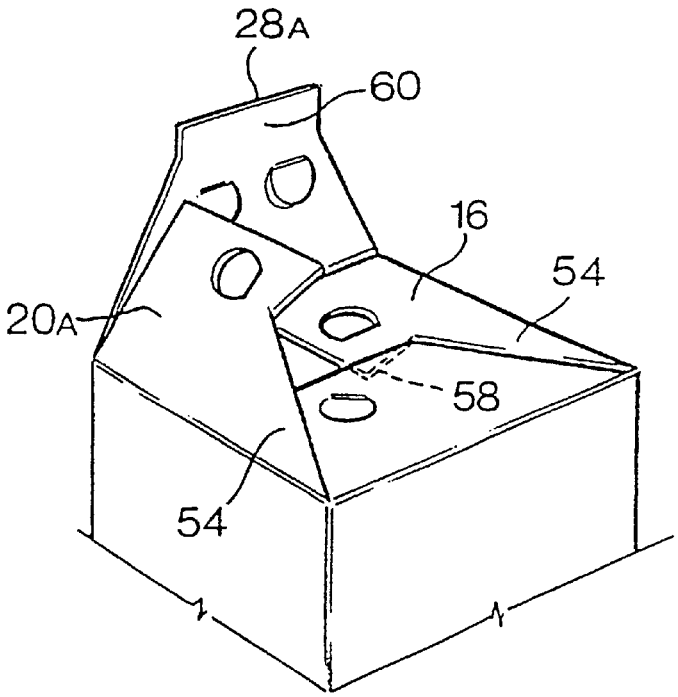
Figure 5:
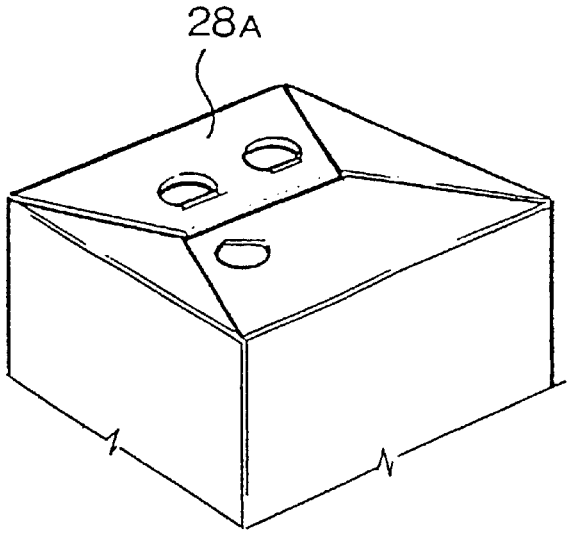

FIGS. 3 to 5 illustrate the sequence of steps which is carried out to form the top of the box 36, but it will be understood that identical steps are carried out to form the bottom of the box. The following description accordingly only refers to the formation of the top of the box. As shown in FIG. 3, the third flap 24A is folded down at right angles to its associated side panel 12.

Next, as shown in FIG. 4, each of the first and second flaps 16A, 20A is folded inwardly such that a tapering portion 54 thereof locates over an edge region 56 of the flap 24A and a corner portion 58 thereof locates beneath a central region of the flap 24A. This interlocks the flaps 16A, 20A and 24A to one another. In the next step, illustrated in FIG. 5, the flap 28A is folded down and a tongue portion 60 thereof is inserted beneath the central region of the flap 24A, over the corner portions of the flaps 16A, 20A. This interlocks the flap 28A with the other flaps.

Figure 6:
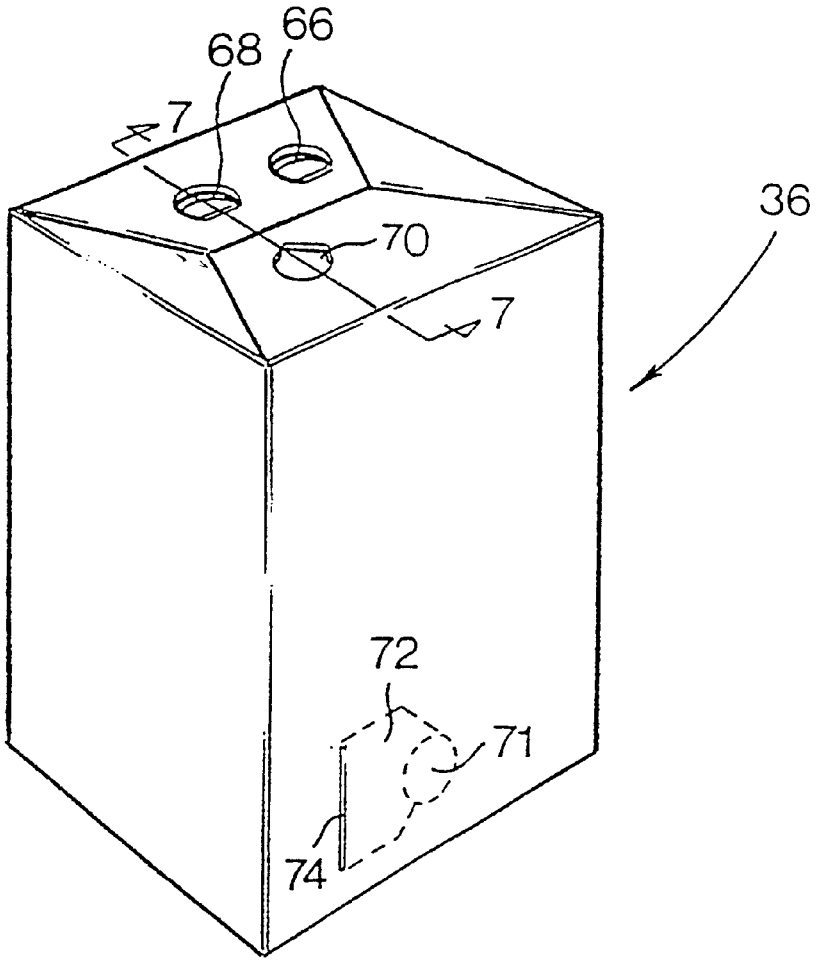
FIG. 6 shows a perspective view of the fully erected box.
Figure 7:
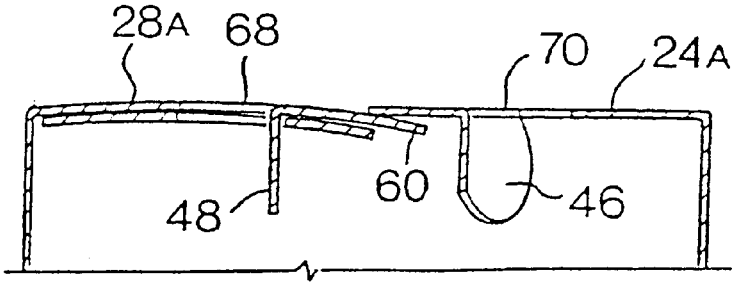
FIG. 7 shows a partial cross-section at the line 7—7 in FIG. 6.

After these steps have been carried out, the finger grip openings in the flap 28A align vertically with the finger grip openings 50 and 52 in the flaps 16A and 20A. The tabs 46, 48 are pressed out as described previously and are folded alongside the straight edges 62 and 64 of the openings 50 and 52. The tab 46 is also pressed out, in a downward direction. The resultant finger grip openings, indicated with the numerals 66, 68 and 70 in FIG. 6, are conveniently located to receive selected fingers of a person wishing to carry the box.

The person may, for instance, insert the first two fingers of his right hand in the openings 66 and 68 and the thumb of his right hand in the opening 70. Alternatively, he may insert the first two fingers of his left hand in the openings 66 and 68 and the thumb of his left hand in the opening 70, depending on his preference and whether he is right or left-handed. In either event it will be noted that as soon as the person takes the load of the box and its contents, the application of fingers to the opposing flaps will draw the interlocking portions of the flaps into firm engagement with one another and prevent them from separating.

The finger grip openings accordingly provide a very secure handle means for the box 36, and this is achieved without the necessity for any separate handle device as in prior boxes used in bag-in-the-box applications.

The downwardly folded tabs 46 and 48 also cushion the person's fingers from the discomfort of direct engagement with sharp edges of the finger grip openings.

Referring again to FIG. 1, the panel 12 carrying the flaps 24A, 24B is formed to provide a valve-receiving and dispensing opening which is used in conventional manner in the bag-in-the-box application. In this application a liquid containing bag with an outlet controlled by a manual valve is accommodated within the box 36. There is a press-out portion 71 and a press-out tab 72 connected to the panel 12 at a fold line 74. With the portion 71 pressed out to form an opening and the tab 72 folded outwardly, the valve of the bag can be pulled outwardly to locate the dispensing opening of the valve outside the box. The tab 72 can then be folded back, in conventional manner, to grip the valve and hold it in this operative position, whereafter the contents of the bag can be dispensed by manipulation of the valve.

A bag suitable for use with the box 36 is described in a co-pending patent application filed simultaneously with the present application by the same applicant.

The absence of a separate handle for the box 36 will, it is believed, make the box economical to manufacture. Added to this, the manner in which a handle is provided obviates the possibility of losing a separate handle.

The material from which the blank is manufactured, such as the CORAPLAS-type material referred to above, preferably has considerable strength and durability, making it possible to re-use the box. Thus when the bag is empty it can be removed through the top of the box after the top has been disassembled by reversing the assembly procedure described above. A full bag can then be inserted into the box in its place before re-assembling the top.

An additional benefit can arise where material from which the blank is made has good insulating properties, such as the CORAPLAS material referred to above, since this will enable the box to keep its contents cool, or warm in the case of warm beverages, for considerable periods of time after refrigeration or heating.

Figure 8:
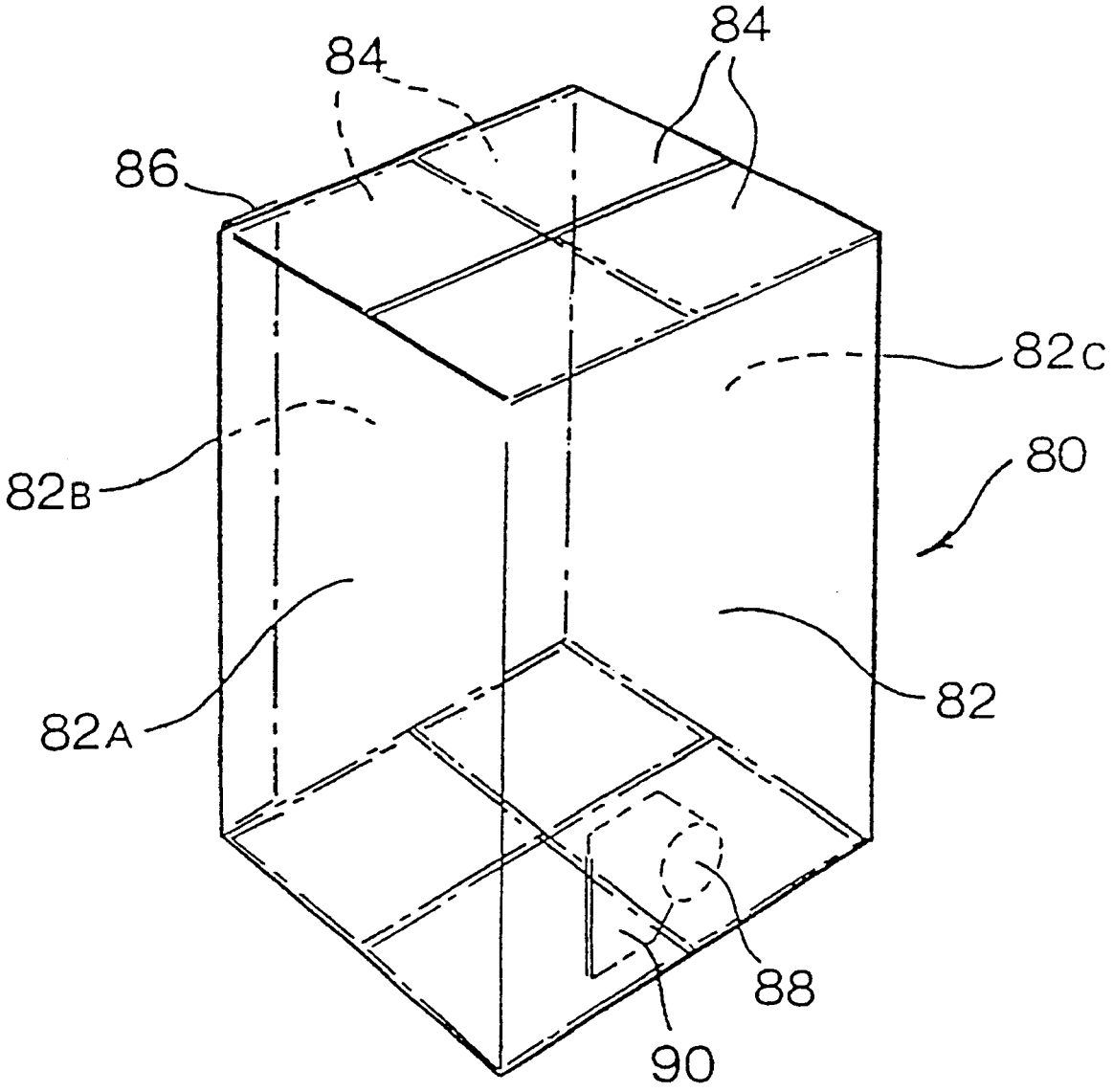
FIG. 8 shows a perspective view of a liner which can be used in the box of the preceding Figures.

The insulating abilities of the box can be improved further with the use of an insulating insert 80 such as that shown in FIG. 8. The insert is in the form of a square section box which has slightly smaller dimensions than the box 36 and which can nest snugly in the box. The insert 80 is made of a high density styrofoam, typically that marketed under the trade mark LAMIFOAM and is folded to have the illustrated configuration from a unitary blank. Each of the four walls 82A to 82D of the insert 80 carries flaps 84 at its opposite ends and these flaps are merely folded against one another to form the top and bottom of the insert. An endmost panel of the blank which forms the side wall 82A carries a narrow flap 86 which, when the side walls panels are erected, is folded against the edge region of the side wall 82B formed by the side wall panel at the other end of the blank. There is no interlocking or adhesive between the various flaps which are held together by the location of the insert in the box 36.

It will be noted that the side wall 82C of the insert 80 is formed with a press-out portion 88 and a press-out tab 90 which align with the corresponding portion 71 and tab 72 of the box 36 when the insert is correctly located in the box.

In use, the liquid-containing bag is accommodated within the insert 80. The bag valve can be withdrawn through the openings which can be created by pressing out the portions 71 and 88 and tabs 72 and 90. The box 36 is carried in the manner described above with the selected fingers located in the openings in the box above the insert. Depending on the relative heights of the box and insert and the space which exists between the top of the insert and the top of the box, it may be necessary to do away with the finger protection tabs 46 and 48 of the box.

As a further feature, the box material may be light-transmitting to enable an observer rapidly to assess how full the bag is, assuming of course that the bag itself is of light-transmitting material and that there is no opaque insert 80. For added aesthetics, the plastic box material may also incorporate a selected colourant, typically blue.

FIGS. 9 to 14 illustrate a currently preferred embodiment of the invention. This embodiment has many similarities to the first embodiment described above and like components are designated with like numerals. The box 100 seen in FIGS. 9 to 14 is formed from a blank having a similar peripheral shape and fold line arrangement to that illustrated in FIG. 1, and the resulting box has substantially the same outer shape. However in this case, the blank is formed of a stiff grade of transparent or translucent plastics material by a vacuum-forming process.

With the vacuum forming process used to form the blank it is possible for the various panels and tabs to be given three dimensions. In particular, the side panels 12 of the resultant box 12 are provided with raised areas including transverse ribs 102 on each side panel as well as generally oval areas 104 on the side and rear panels, a rectangular area 106 on the front panel in which the valve opening 108 is formed, generally rectangular areas 110 adjacent the opening 108 and shaped, raised areas 112 on the flaps 24A and 28A.

The raised areas mentioned above have a two-fold purpose. In the first place, they serve to strengthen and rigidify the box, thereby improving its longevity and re-usability. In the second place, the raised areas increase the overall volume within the box, thereby enabling the box to accommodate a bag of greater volume than would be the case were the side panels and flaps merely to be of planar shape. For instance, the illustrated box is designed to accommodate a flexible bag having a liquid storage volume of six liters with a footprint, i.e. base dimensions, corresponding to those of a box with planar side walls and only designed to accommodate a bag of five liter capacity.

The box 100 is erected in the same way as the box 36 described above. With the use of stiff plastics material to form the box, the flap 28A can merely be pressed downwardly, once the flaps 24A, 20A and 16A have been correctly folded into position, so that its tongue portion 60 clips beneath the central region of the flap 24A, over the corner portions of the flaps 16A and 20A as described above. Although of a relatively stiff nature, the inherent resilience of the box material enables the flaps 24A, 16A, 20A and 28A to be disengaged from one another in order to open the box for, for instance, insertion of a fresh bag of liquid.

It will be noted that in the embodiment of FIGS. 9 to 14 finger grip openings 66, 68 and 70, identical to those in the first embodiment, are formed.

The valve opening 108 differs from the arrangement described above in that it consists of a circular aperture 114 with series of angularly spaced slits 116 emanating radially from the aperture. Once again, the inherent flexibility of the box material enables the dispensing valve of the bag to be pulled outwardly through the aperture with the tabs formed between the slits 116 then anchoring the valve in position in the manner of a locking dog.

In the first embodiment, the narrow tab 32 is glued to the inner surface of the opposite side panel 12. In the present embodiment, the corresponding tab is provided, during manufacture of the blank, with small holes to receive male (or female) press-stud components. The remote edge of the opposite side panel 12 is also formed with openings to receive female (or male) press-stud components. On erection of the box, the male and female press-stud components, which are omitted from FIGS. 9 to 14 in the interests of clarity, are pressed together to form the side panels 12 into the required tubular shape. It will be understood that connection methods other than press-studs, for instance suitable adhesive, welding or the like could also be used.

The raised area 106 could be used to support a separate identification panel (not shown). This panel could, for instance, be a vacuum formed sheet of plastics material with a three-dimensional representation of, say, an orange, lemon or the like in order to indicate, when supported by the area 106, the contents of the bag in the box.

This would obviate the need for affixing separate paper or other labels to the box 100. In order to support the identification panel the corners of the area 106 could be formed during manufacture with formations, such as under-cuts, to receive and retain the corners of the panel.

FIGS. 12 to 14 illustrate a stand 120 which can be used in conjunction with the box 100. The stand is formed of bent stainless steel wire to have a square ring 122 and four legs 124. When the box is to be used to dispense liquid from a bag which it contains, the stand 120 is arranged on its legs 124 on a horizontal supporting surface such as a table top. The lower edges of the box are then supported in the ring as illustrated in FIG. 13. Referring also to FIG. 14, it will be noted that the lower periphery of the box is formed with a recess 126 in which the ring 122 locates. The recess is defined between a projecting rib 128 at the lower extremity and the underside of the lowermost raised ribs 102 on the side panels 12. When the ring is received in this recess, the ribs 102 accordingly rest on the ring to provide adequate support for the box and its contents.

During storage and transportation of the box 100, the legs 104 are slipped downwardly over the upper corners of the box. The upper periphery of the box has a shape identical to that at the lower periphery, so the ring rests, in a recess and against the uppermost ribs 102 on the side panels 12, as shown in broken outline in FIG. 12. With the stand in use as shown in FIG. 13, the box 100 is elevated above the supporting surface, thereby facilitating dispensing of liquid from the bag contained therein. With the stand in the position seen in broken outline in FIG. 12, the stand provides reinforcement and protection for the upper region of the box during transportation and storage.

Figure 2:
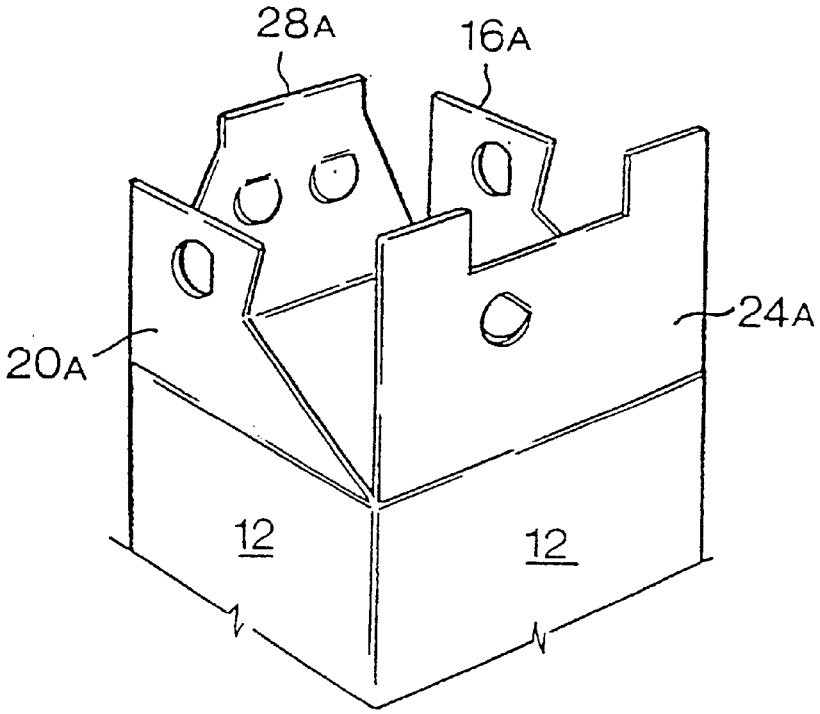
FIG. 2 shows the top of a box partially erected from the blank of FIG. 1.

FIG. 15 shows a typical liquid storage and dispensing bag 200 which can be accommodated within the box 36 or the box 100. The bag 200 is described in detail in the co-pending patent application, referred to above and filed simultaneously with the present application by the same applicant. For present purposes it suffices to point out that the bag is formed by plies of transparent plastics material, possibly polypropylene, heat sealed to one another to form an internal liquid storage volume 202, a handle region 204 at the upper end, and a dispensing valve 206 towards the lower end. The handle region is perforated by four openings 206 enabling the bag to be gripped and carried by the four fingers on a human hand. In use, with the top of the box 36, 100 open as shown in FIG. 2, the bag, full of liquid, is slipped downwardly into the box and the dispensing valve is pulled outwardly through the valve opening in the front side, panel of the box. The top of the box is then closed by following the sequence of steps described above with reference to FIGS. 3 to 5.

With the bag in position, the valve is manipulated in the normal way to dispense liquid from the bag. When the bag is empty, it is a simple to re-open the top of the box, remove the bag and replace it with a fresh bag.

As indicated above, the plastics material of which the box 100 is made is transparent or translucent. This feature, in combination with the transparent nature of the bag 200, makes it easy to assess the contents of the bag visually without having to remove the bag from the box. Also, when the bag contains a clear liquid such as mineral water, the light-transmitting nature of the bag and box give the combination the aesthetically pleasing appearance of a block of ice.

This appearance is enhanced if the bag is inserted into the box in such a way that creases, which give the impression of cracks in the ice, are formed in the bag. It will be noted that the illustrated bag 200 includes obliquely orientated heat seal lines which facilitate the formation of such creases.

The plastics material which is used to form the vacuum-formed blank from which the box of FIGS. 9 to 14 is erected could be any one of a variety of suitable semi-rigid plastics materials including PET (polyethylene teraphthalate), PVC (polyvinyl chloride), polystyrene, high impact polystyrene, polypropylene or nylon. As indicated above, the material is preferably clear or translucent, but it is also within the scope of the invention for it to be full-coloured or opaque.

It is also within the scope of the invention for the box to be erected from a blank of flat, semi-rigid plastics material, typically one of the plastics materials mentioned above, instead of a vacuum-formed blank.

What is claimed is:

1. A box for containing a bag and formed from a blank, comprising first, second, third and fourth sides having upper and lower edges;

a rectangular bottom coupled to said lower edges of said sides;

a rectangular top including first, second, third and fourth flaps hingedley coupled to said upper edges of said first, second, third and fourth sides, respectively, along fold lines, each of said flaps overlapping and releasably interlocking with at least one other of said flaps; and finger-grip openings in said flaps dimensioned to receive fingers of a person carrying the box, said openings being in at least each of an opposing pair of said flaps, said opposing pair of said flaps partially overlapping and releasably interlocking with one another, said openings being arranged such that when the box is carried by fingers received in said openings is said opposing pair of said flaps interlocking prevents said flaps from separating from one another.

2. A box according to claim 1 wherein said first and second flaps are identical and oppose one another;

said third flap is engaged by said first and second flaps with said first and second flaps located partially over and partially beneath said third flap;

said fourth flap has a tongue portion located partially over said first and second flaps and beneath said third flap at a position where said first and second flaps are beneath said third flap;

each of said first, second and third flaps has one of said openings; and said fourth flap has two of said openings spaced from one another and aligned with said openings in said first and second flaps.

3. A box according to claim 1 wherein said openings comprise holes in said flaps.

4. A box according to claim 1 wherein said openings comprise press-out tabs in said flaps.

5. A box according to claim 1 wherein one of said sides comprises an opening to receive a valve attached to a bag locatable inside the box.

6. A box according to claim 1 wherein said top, bottom and sides form a cardboard blank.

7. A box according to claim 1 wherein said top, sides and bottom form a blank comprising extruded plastic sheets with parallel skins spaced apart from and connected integrally to one another by intermediate webs transverse to said skins.

8. A box according to claim 1 wherein said top, bottom and sides form a vacuum formed blank of plastic material.

9. A box according to claim 1 wherein said top, bottom and sides form a blank of light-transmitting material.

10. A box according to claim 1, wherein a stand supports the box above a supporting surface, said stand including an upper portion engaging the box and a plurality of legs supporting said upper portion above the supporting surface.

11. A box according to claim 1 wherein a bag is located in the box, said bag including a liquid storage volume, an outlet from said liquid storage volume, a manually operable bag for controlling flow of liquid through said outlet, and an operatively upper region formed with finger grip openings by means of which the bag can be gripped and carried by the fingers of a human hand.

12. A box according to claim 1 wherein each of said flaps comprises at least one of said finger-grip openings therein.

13. A box according to claim 2 wherein said openings comprise press-out tabs in said flaps.

14. A box according to claim 2 wherein each of said flaps comprises at least one of said finger-grip openings therein.

15. A box according to claim 8 wherein said sides comprise raised areas.

16. A box according to claim 15 wherein said raised areas comprise transverse raised ribs adjacent said top and said bottom.

17. A box according to claim 10 wherein said upper portion of said stand comprises a rectangular ring; and said sides include raised, transverse ribs adjacent said bottom, said ring being dimensioned to receive said bottom with said ribs resting thereon.

18. A box according to claim 10 wherein said sides include raised, transverse ribs adjacent said top; and said stand comprises a rectangular ring locatable with said ring resting on said ribs and having legs extending down comers of the box.

19. A box according to claim 10 wherein a liquid storage and dispensing bag charged with liquid is located in the box.

* * * * *